US005675106A

United States Patent [19]

Leiter

[11] Patent Number: 5,675,106

[45] Date of Patent: Oct. 7, 1997

[54] BLANK FIRING CONVERSIONS FOR SEMIAUTOMATIC PISTOLS

[76] Inventor: Edward J. Leiter, Satis House, Tower Hill Rd., Tuxedo Park, N.Y. 10987

[21] Appl. No.: 487,458

[22] Filed: Jun. 7, 1995

Related U.S. Application Data

[63] Continuation of Ser. No. 298,416, Aug. 30, 1994, Pat. No. 5,585,589, which is a continuation-in-part of Ser. No. 230, 295, Apr. 20, 1994, abandoned, which is a continuation-in-part of Ser. No. 132,051, Oct. 5, 1993, Pat. No. 5,433,134.

[51] Int. Cl.[6] ..... F41A 21/00

[52] U.S. Cl. ..... 89/14.5; 89/128; 89/162; 89/163; 89/196; 42/7; 42/77

[58] Field of Search ..... 42/7, 77; 89/14.5, 89/128, 162, 163, 196

[56] References Cited

U.S. PATENT DOCUMENTS

| | | | |
|---|---|---|---|
| 808,003 | 12/1905 | Browning | 89/163 |
| 863,770 | 8/1907 | Whiting | 89/196 |
| 936,967 | 10/1909 | Whiting | 89/196 |
| 1,168,985 | 1/1916 | Whiting | 42/7 |
| 1,377,629 | 5/1921 | Rosebush | 42/75.03 |
| 1,563,675 | 12/1925 | Tansley | 89/128 |
| 2,872,850 | 2/1959 | Davenport | 89/159 |
| 2,898,693 | 8/1959 | Ruger | 42/77 |
| 3,207,037 | 9/1965 | Pachmayr et al. | 89/196 |
| 3,504,594 | 4/1970 | Greeley | 89/163 |
| 3,724,326 | 4/1973 | Day | 89/196 |
| 3,731,590 | 5/1973 | Zimmerman, Jr. | 89/163 |
| 3,756,120 | 9/1973 | Roy | 89/163 |
| 3,901,125 | 8/1975 | Raville | 89/163 |
| 4,222,308 | 9/1980 | Arnett | 89/163 |
| 4,253,377 | 3/1981 | Arnett | 89/163 |
| 4,580,484 | 4/1986 | Moore | 89/128 |
| 4,854,217 | 8/1989 | Ransom | 89/163 |
| 4,887,510 | 12/1989 | Wynn | 89/163 |
| 4,907,489 | 3/1990 | Teague | 89/14.5 |
| 4,920,676 | 5/1990 | Peters | 42/25 |
| 5,415,075 | 5/1995 | Moon | 89/163 |
| 5,433,134 | 7/1995 | Leiter | 89/14.5 |

FOREIGN PATENT DOCUMENTS

| | | | |
|---|---|---|---|
| 412523 | 7/1910 | France | 89/196 |
| 477693 | 11/1915 | France | 89/196 |
| 319648 | 4/1920 | Germany | 89/196 |
| 20367 | 9/1910 | United Kingdom | 89/196 |
| 2163840 | 3/1986 | United Kingdom | 89/14.5 |

*Primary Examiner*—J. Woodrow Eldred
*Attorney, Agent, or Firm*—Dilworth & Barrese

[57] ABSTRACT

An automatic pistol adapted to repetitively fire blank ammunition includes a frame, a barrel unit supported by the frame and a slide unit reciprocally mounted on the frame between the forward and rear position. The barrel unit and/or frame incorporate structure which enables the pistol to operate in a highly reliable, repetitive manner without visible alteration to the pistol. A method for forming a blank firing pistol is also disclosed.

25 Claims, 12 Drawing Sheets

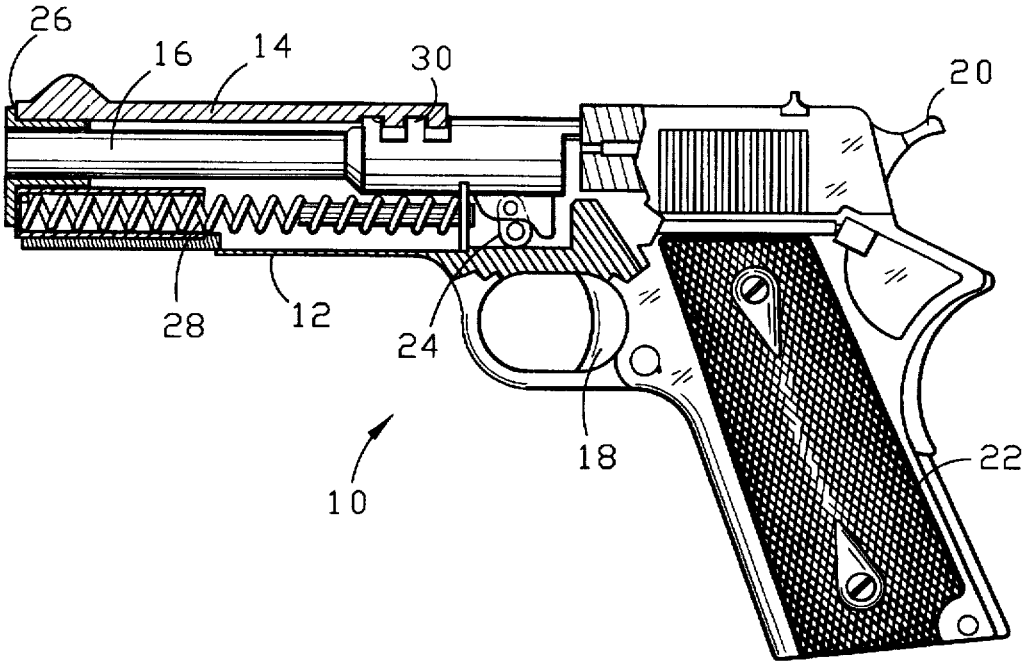
FIG. 1–PRIOR ART
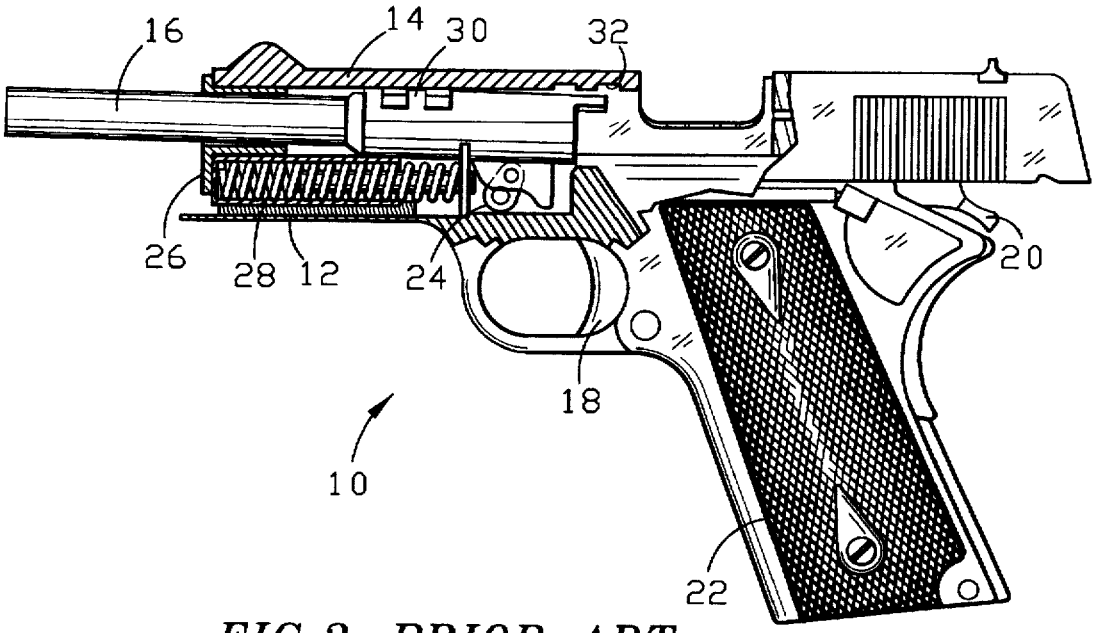
FIG. 2–PRIOR ART

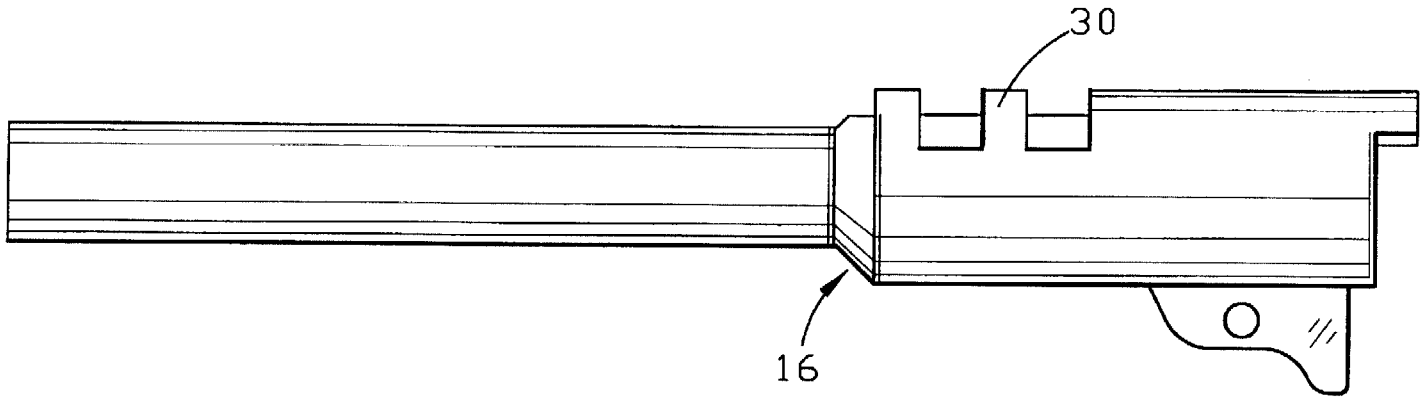
FIG.5–PRIOR ART
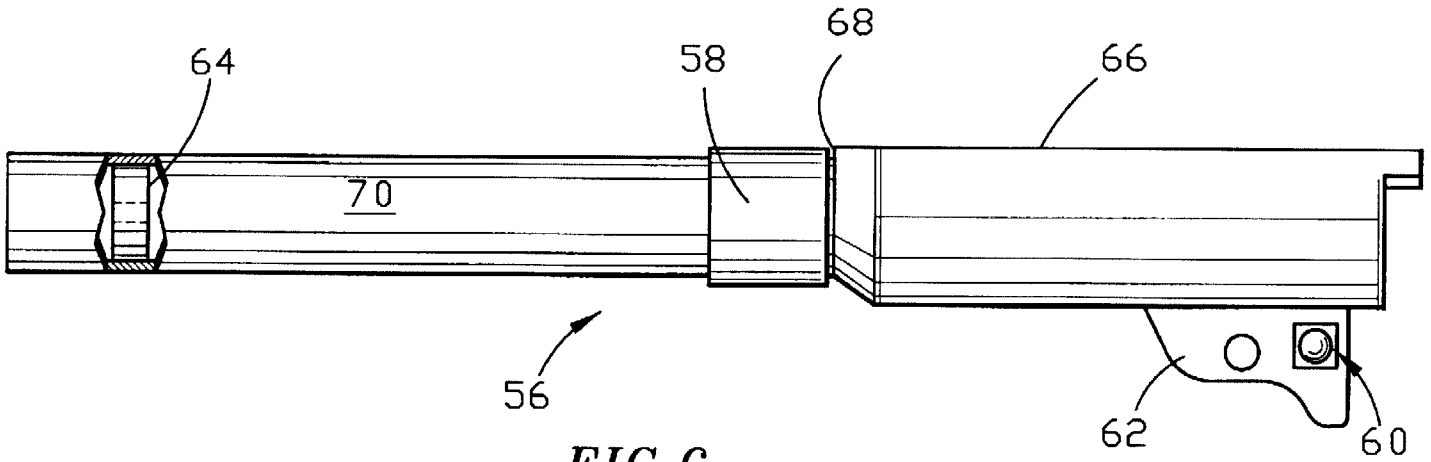
FIG.6

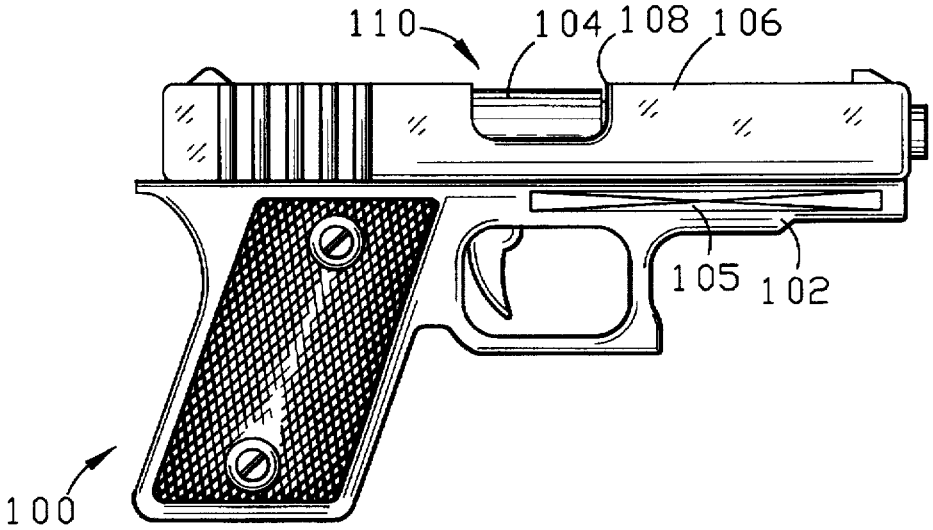
FIG. 11–PRIOR ART
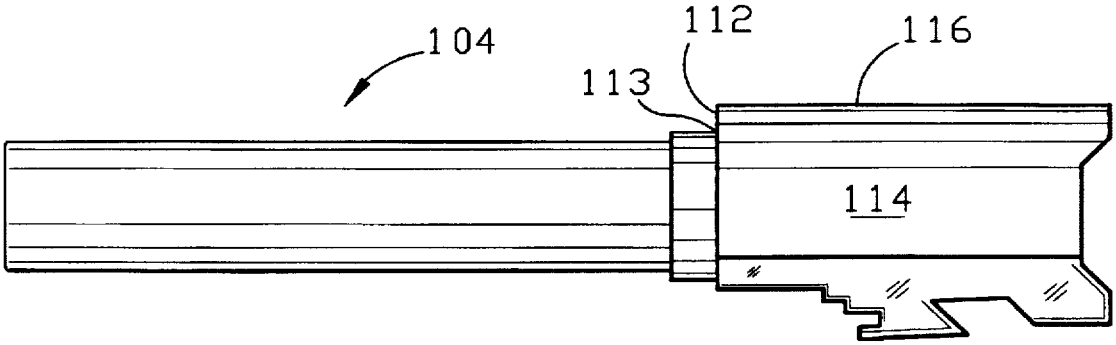
FIG. 12–PRIOR ART

BLANK FIRING CONVERSIONS FOR SEMIAUTOMATIC PISTOLS

CROSS REFERENCE TO RELATED APPLICATIONS

This is a continuation of application Ser. No. 08/298,416, filed Aug. 30, 1994, now U.S. Pat. No. 5,585,589, which is a continuation-in-part of U.S. patent application Ser. No. 08/230,295, filed Apr. 20, 1994, abandoned, which is a continuation-in-part of U.S. patent application Ser. No. 08/132,051, now U.S. Pat. No. 5,433,134, filed Oct. 5, 1993.

BACKGROUND OF THE INVENTION

The present invention relates generally to firearms and, in particular, to modifications made to standard semiautomatic breech-locked, recoil operated firearms for producing reliable, repetitive blank-fire capability in these pistols.

In many conventional semi-automatic weapons, including the BROWNING and "COLT"/BROWNING family of pistols, a breech-lock, recoil activated system is utilized where the barrel and slide are locked together for a predetermined distance in response to firing of a bullet to effect a complete firing cycle, i.e., the opening of the breech after firing a shot, the extraction and ejection of the empty cartridge shell, the cocking of the hammer, the presentation and introduction of a loaded cartridge to the barrel and the closing of the breech are automatically effected through the energy of recoil of the breech closing part. Since by nature breech-locked, recoil activated firearms rely upon the phenomenon of projectile motion within the barrel—which is derived from the projectile mass of the bullet—to create the recoil forces necessary to effect repetitive cycling of the mechanism, blank-fire in this class of firearm will not ordinarily impart the appropriate type or degree of force necessary to effect repetitive cycling of the mechanism. Even with the presence of a bore-restricting element to augment gas pressure and rearward gas thrust against the breech face, the type of force generated is qualitatively different from that evidenced in projectile-motivated live-fire conditions where the projectile's moment of inertia produces recoil characteristics that overcome the breech-locking impediment.

In an effort to overcome the breech-locking impediment so as to fire blank ammunition, the breech locking element in this type of firearm may be eliminated, in effect to create a blowback system of operation devoid of any breech-locking barrel interconnection in an attempt to bypass the problematic absence of forces in projectile-free blank ammunition. However, elimination of the breech-locking features manifests other difficulties in operation of the pistol such as cartridge ejection, cartridge feeding and slide return into battery.

U.S. Pat. No. 4,907,489 to Teague relates to a blank fire configuration for a recoil operated automatic pistol for converting a standard live-fire pistol to a blank-firing pistol. In accordance with the Teague '489 device, the live-fire barrel of the pistol is replaced with a modified short barrel to which an inner sleeve is threadably attached. An outer sleeve is also provided to receive the inner sleeve in a telescopic arrangement. A barrel anchor is secured to the pistol frame and a spring retention rod projects from the barrel anchor to receive a shortened recoil spring.

The aforementioned Teague '489 device is subject to several disadvantages which limit its usefulness. Most significant of these disadvantages is that the Teaque '489 device results in an obvious alteration in the outward appearance of the firearm, by the creation of an uncharacteristic muzzle signature and the corruption of manifest design elements by the introduction of components not indigenous to the design of live-fire automatic pistols.

Accordingly, the present invention is directed to a superior, highly efficient, comparatively simple, cost effect pistol adaptation which produces reliable, repetitive blank-fire capability. While incorporating a bore-occluding restrictor of appropriate geometries to generate back pressure within the firearm in a manner well known in the art, the novel elements of blank-fire modification of the present invention accomplish highly reliable, repetitive operation without visible alteration to the firearm, thus importing an exceptional degree of verisimilitude.

SUMMARY OF THE INVENTION

The present invention is directed to an automatic pistol adapted to automatically and repetitively fire blank ammunition. The pistol includes a frame, a barrel unit moveable relative to the frame between a forward battery position where the pistol is capable of firing and a rear loading position where a live blank cartridge is received within the barrel chamber portion of the barrel unit and a modified slide unit. The slide unit is reciprocally mounted on the frame between a forwardmost position and a rearmost position. The slide unit includes an abutment surface positioned and dimensioned to engage an abutting surface of the barrel unit upon rearward movement of the slide unit to a position displaced from the forwardmost position. Consequently, this delay in engaging the abutting surface of the barrel unit permits the slide to achieve unimpeded rearward velocity and acquired momentum during the initial stages of recoil to drive the barrel unit rearwardly to the rear loading position where a blank cartridge is loaded within the barrel chamber portion. The abutment surface is preferably disposed towards the forward end of the slide displaced from a slide ejection port area thereof.

The present invention is also directed to a method for converting an automatic pistol to fire blank ammunition, the automatic pistol being of the type including a frame, a slide reciprocally mounted on the frame between a forwardmost position and a rearmost position, and a barrel unit including a barrel chamber portion, a barrel element extending from the barrel chamber portion and a cartridge feed ramp extending from a lower surface of the barrel chamber portion. The juncture of the barrel chamber portion and the barrel element defines an abutting surface. The barrel unit is supported by the frame in at least a first forward position of the barrel unit by engagement of a frame supporting surface or cam of the frame with the lower surface of the cartridge feed ramp. As the barrel unit moves rearwardly to a second rearward position, the lower surface of the cartridge feed ramp clears the frame supporting surface to permit the barrel unit to move downwardly to a loading position where a cartridge is loaded within the barrel chamber portion. The method includes the steps of positioning a restrictor element in the barrel element to generate sufficient back pressure in the barrel unit upon firing of a blank cartridge to move the slide to the rearmost position thereof and reducing the length of the original lower surface of the cartridge feed ramp a predetermined distance to permit the barrel unit to move prematurely downwardly to the position where the cartridge is loaded within the barrel chamber portion. This reduction effectually minimizes the time and distance for the barrel unit to drop downwardly into its cartridge loading position and, consequently, reduces the amount of recoil force to drive the slide and barrel unit rearwardly. The method may also include the step of altering the original abutting surface of the barrel unit to define a modified abutting surface. The modified abutting surface defines a plane oriented at an oblique angle relative to a longitudinal axis of the barrel element and is configured and dimensioned to be engaged by the abutment surface of the slide upon rearward movement of said slide to a position displaced from the forwardmost position such that said slide generates sufficient momentum to move the barrel unit rearwardly.

BRIEF DESCRIPTION OF THE DRAWINGS

Preferred embodiments of the invention are described hereinbelow with reference to the drawings wherein:

FIG. 1 is a side elevational view in partial cross-section of a semiautomatic "COLT"/BROWNING derivative pistol to be modified in accordance with the principles of the present invention depicted prior to modification and firing of the pistol;

FIG. 2 is a side elevational view in partial cross-section of the firearm of FIG. 1, illustrating the positioning of the operating components after firing of the pistol;

FIG. 5 is an enlarged side elevational view of the barrel of the pistol of FIG. 1 prior to modifying same in accordance with the principles of the present invention;

FIG. 6 is an enlarged side elevational view of the modified barrel of the pistol of FIGS. 3 and 4 modified in accordance with the principles of the present invention;

FIG. 10 A is an enlarged cross-sectional view taken along the lines 10A–10A of FIG. 10;

FIG. 11 is a side elevational view of a "GLOCK"/SIGSAUER Type derivative pistol to be modified in accordance with the principles of the present invention depicted prior to modification and firing of the pistol;

FIG. 12 is an enlarged side elevational view of the barrel of the "GLOCK"/SIGSAUER Type pistol of FIG. 11 prior to modifying same in accordance with the principles of the present invention;

DETAILED DESCRIPTION OF THE PREFERRED EMBODIMENTS

Figure 3:
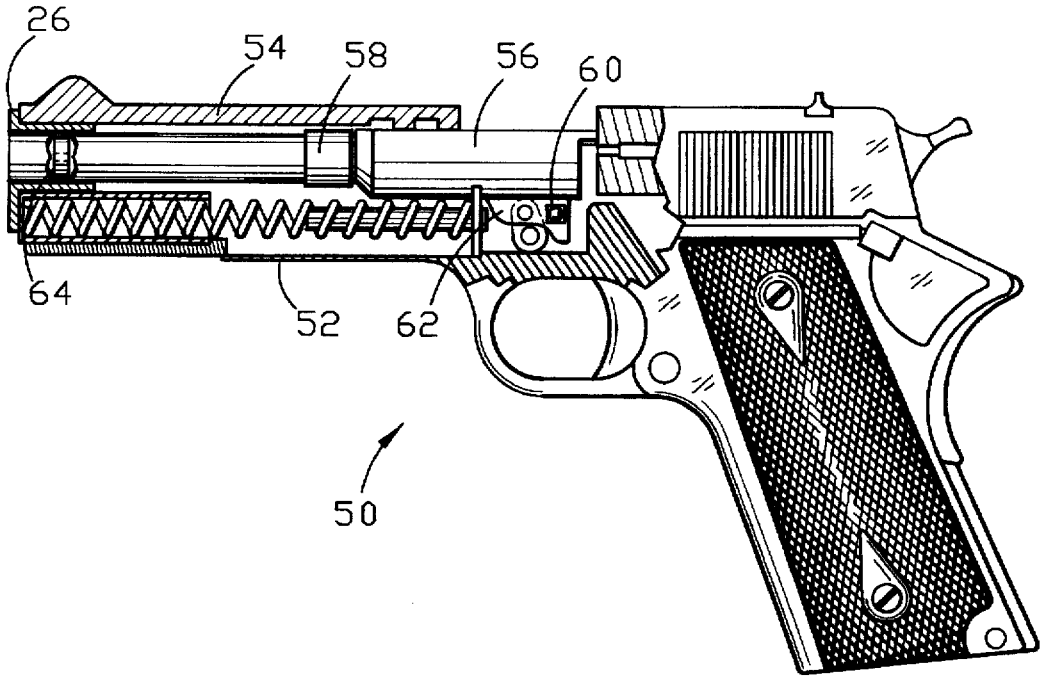
FIG. 3 is a side elevational view in partial cross-section of the pistol of FIG. 1 modified in accordance with the principles of the present invention to fire blank ammunition in an automatic repetitive manner with the pistol being depicted prior to firing.

Referring initially to FIGS. 1 and 2, there is illustrated a standard. "BROWNING" design, "COLT" M1911/45 ACP firearm which may be modified to fire blank ammunition in accordance with the principles of the present. Generally, pistol 10 includes three principal components, namely, frame 12, slide 14 mounted on frame 12 and barrel 16. Frame 12 includes trigger mechanism 18 having hammer 20 and handle or grip portion 22.

Slide 14 is mounted on frame 12 and is adapted for reciprocal longitudinal movement on the frame in response to firing of the pistol. Barrel 16 is slidable and tillable relative to slide 14 and is operatively connected to frame 12 through linkage mechanism 24. The forward end of slide 14 is provided with slide bushing 26 which is positioned over the muzzle of barrel 16 to support the forward end of the barrel during operation of the pistol. Pistol 10 also includes a recoil spring mechanism identified generally as reference numeral 28 positioned below barrel 16 to return slide 14 to the forward battery position after recoil. A breech lock mechanism in the form of locking ribs 30 provided on the top of barrel 16 and correspondingly dimensioned recesses 32 formed in the upper surface of slide 14, as in conventional pistols of this type, is also provided. Recesses 32 receive ribs 30 to securely interlock the slide 14 and the barrel 16 when the pistol is in the forward battery position of FIG. 1.

Upon ruing a live cartridge with projectile element, the recoil action of the bullet forces slide 14 rearwardly and, due to its interconnection with the barrel 16, barrel 16 moves rearwardly. As barrel 16 moves rearwardly, linkage mechanism 24 connected to the rear under portion of the barrel 16 and the frame 12 causes simultaneous downward movement of the barrel, thus effecting release of the breech lock mechanism, i.e., the locking ribs 30 become disengaged from recesses 32. In consequence of this downward substantially arcuate motion of barrel 16, the cartridge case, while still contained within the firing chamber of barrel 16 is drawn downwardly along the breech face of slide 14, and is subsequently extracted from the chamber after barrel motion is arrested—so to be expelled positively from the weapon by an ejector element (not shown). A subsequent cartridge in the magazine (not shown) is fed into the firing chamber to permit continued successive firing of subsequent cartridges. Recoil spring mechanism 28 then drives slide 14 to the forward battery position in a conventional manner. FIG. 2 illustrates the movement of slide 14 and barrel 16 after firing of the pistol 10.

Figure 4:
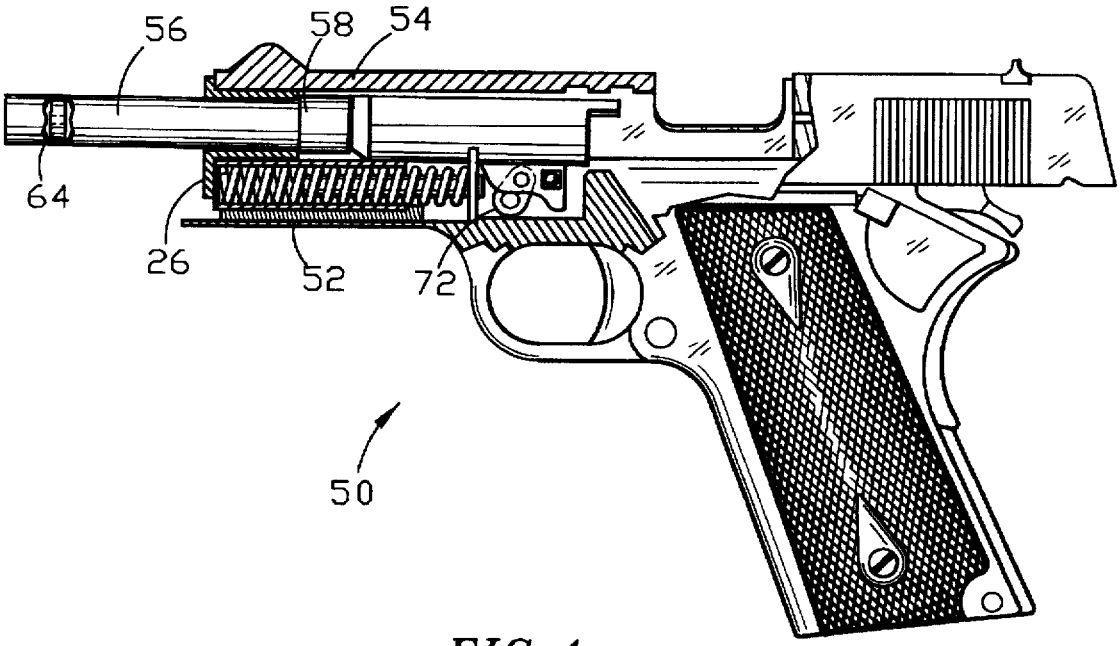
FIG. 4 is a side elevational view of the modified pistol for firing blank ammunition of FIG. 3 subsequent to firing of the pistol.

Referring now to FIGS. 3–4, there is illustrated the novel blank-fire semiautomatic pistol constructed in accordance with the principles of the present invention. FIG. 3 is a side elevational view of the blank firing pistol in a forward battery position. FIG. 4 is a similar view depicting the modified pistol in a rearward position after firing. As shown in FIGS. 3–4, modified pistol 50 incorporates the three basic components present in the pistol of FIGS. 1 and 2, namely, frame 52, slide 54 mounted on frame 52 and adapted for reciprocal longitudinal movement relative to the frame and modified barrel 56. Pistol 50 also includes barrel bushing 58, a spring loaded detent mechanism 60 adjacent linkage housing 62 of barrel 56 and a bore restricting element 64 positioned within the forward end portion of the modified barrel 56. The features and significance of bushing 58 and detent mechanism 60 will be discussed in greater detail below.

Bore restricting element 64 serves in increasing the back-pressure of propellant gases to facilitate firing of the blank ammunition and may be of conventional type. One suitable bore restricting element to increase such back pressure is disclosed in U.S. Pat. No. 5,140,893 to Leiter, the contents of which are incorporated herein by reference. The blank firing adapter disclosed in Leiter '893 includes a propellant gas-occluding passage which terminates in a conical zone defined upon the rear surface of the adapter. The length of the gas-occluding passage of the Leiter '893 device is less than the diameter of the adapter.

Referring now to FIGS. 5 and 6, the modified barrel 56 of pistol 50 for firing blank ammunition will be described in detail. FIG. 5 illustrates a conventional barrel for firing live ammunition such as the barrel incorporated in the pistol of FIGS. 1 and 2. FIG. 6 illustrates the barrel 56 modified in accordance with the present invention and which is a component of the pistol of FIGS. 3 and 4. As shown in FIG. 6, modified barrel 56 includes a substantially planar barrel hood area 66, in which the barrel locking ribs have been removed (compare FIG. 5), to bypass the mechanical impediment of the breech locking mechanism, to account thereby for the absence of force of projectile free blank ammunition. Such removal of the breech locking mechanism converts the pistol 50 from breech locked operation to a blowback function. An abutment shoulder 68 is defined at the intersection of the forward end portion of the planar hood area 66, and barrel element 70, the importance of which shoulder 68 will become apparent from the description provided below.

Referring now to FIGS. 3 and 4, in conjunction with FIG. 6, the features of bushing 58 will be described in detail. Bushing 58 is positioned forward of the chamber swell area as shown and is appropriately dimensioned to impinge upon original slide bushing component 26 as slide 54 moves rearwardly in response to firing of the pistol, thereby driving barrel 56 rearwardly and downwardly via linkage mechanism 72 to its appropriate position to extract a spent cartridge and receive a live cartridge from the magazine. Bushing 58 is appropriately dimensioned to permit unrestricted rearward movement of slide 54 for a predetermined distance after firing without engagement of slide bushing 26 with barrel bushing 58 such that slide 54 generates adequate momentum to drive the barrel 56 rearwardly once the slide bushing 26 contacts the bushing 58. One skilled in the art may readily determine the appropriate dimension of barrel bushing 58 to achieve this objective. Bushing 58 may be a permanently positioned and fixed element of barrel unit 56 and may be integrally incorporated into barrel 56 during manufacturing or laterally secured by appropriate methods such as by brazing or welding.

Figure 7:
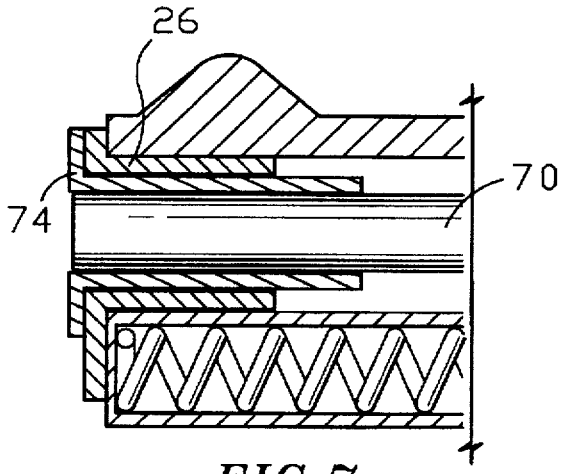
FIG. 7 is a partial enlarged sectional view of the forward end portion of an alternative embodiment of the modified barrel of FIG. 6 with a bushing insert positioned within the original slide bushing.

In an alternative embodiment shown in FIG. 7, the above-described rearward movement of barrel 56 may be achieved by positioning an extended bushing insert 74 within the original slide bushing 26 about the forward end of barrel element 70 and securing the insert 74, by appropriate means such as soldering or welding, to the slide bushing 26. Such effective rearward extension of bushing 26 may be accomplished integrally during original manufacture of bushing element 26. Bushing insert 74 is strategically dimensioned to extend beyond the rear end portion of original slide bushing 26 so as to engage abutment shoulder 68 (FIG. 6) of modified barrel 56 during the recoil stage of operation to drive barrel 56 rearward and downwardly via linkage 72 to effect appropriate positioning of the barrel to eject the expended cartridge case. It is to be appreciated that bushing insert 74 is also appropriately dimensioned to permit unrestricted movement of slide 54 for a predetermined distance without engaging abutment shoulder 68 of barrel 56 so as to generate adequate momentum to move the barrel rearwardly once the insert contacts the shoulder 68. One skilled in the art may readily determined the appropriate dimensioning of bushing insert 74 to effect such action.

Referring now to FIGS. 3 and 4, in conjunction with the cross-sectional view of FIG. 8, the function and position of the spring loaded detent mechanism 60 will be described. As previously addressed, under live fire conditions barrel 56 is driven rearwardly and downwardly into ejection/feeding position. In the unmodified conventional pistol of FIGS. 1 and 2, the presence of linkage mechanism 24, together with the contact presented by barrel locking ribs 30 upon the underside of the fully retracted slide 14 in its normal recoil position, positively prevents the barrel 56 from becoming dislodged in the forward direction from its rearward contact with the frame feeding ramp (not shown) under the forward thrust of a subsequent cartridge as the cartridge strikes the chamber area during loading of the cartridge. However, since in the modified barrel of FIGS. 3, 4 and 6 of the present invention the contact between the barrel and slide underside has been eliminated, the normal motion and thrust of subsequent blank cartridges into the barrel chamber from the magazine would cause barrel 56 to be driven forward, out of Contact with the frame feeding ramp, (not shown) thus causing a failure to chamber or a jamming action. Accordingly, in order to correct for the absence of barrel/slide interconnection during discharge of blank ammunition, a mechanical impediment in the form of a spring-loaded ball detent mechanism 60 is incorporated to replace the function of barrel rib/slide underside contact until a cartridge has been successfully chambered.

Figure 8:
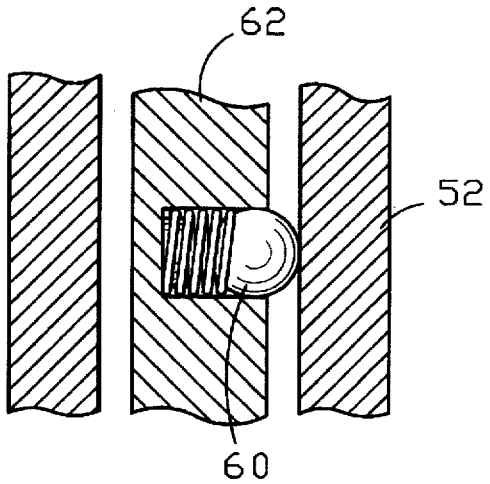
FIG. 8 is a partial fragmentary sectional view of the spring ball detent mechanism of the modified pistol of FIGS. 3 and 4.

Referring particularly to FIGS. 3, 6 and 8 the detent mechanism 60 is disposed at the side of the linkage housing 62 beneath the barrel 50 and exerts an outward force against the inner surface of frame 52. The geometries of the ball detent mechanism are made to correspond with the geometries of the barrel linkage housing 62, frame 52, requisite frictional force to overcome the thrust of the momentum of blank ammunition being funneled into the chamber and the necessity that such frictional force exerted by the detent 60 against the frame 52 be less than the force generated by the momentum of the slide as it strikes the rear end of the barrel during the return to battery phase. One skilled in the art may readily determine the appropriate geometries of ball-detent mechanism to accomplish this objective.

Figure 9:
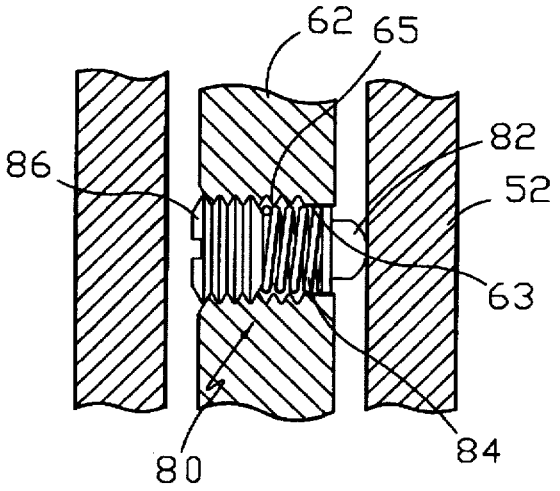
FIG. 9 is a partial sectional view of an alternative detent mechanism to be incorporated in the modified pistol of FIGS. 3 and 4.

As an alternative to the spring loaded ball detent mechanism 60 shown in FIG. 8, a plunger detent mechanism 80 depicted in FIG. 9 may be incorporated within the modified pistol to arrest or positively retain barrel 56 in its rearward cartridge feeding position. Plunger detent mechanism 80 includes detent plunger 82, helical spring 84 and threadably engageable set screw 86 which retains the detent plunger 82 and helical spring 84 within linkage housing 62 or barrel housing with a SMITH & WESSON derivative firearm. Similar to the ball detent mechanism 60 of FIG. 8, plunger detent mechanism 80 is at least partially disposed within a channel 63 formed in linkage housing 62, or the barrel housing of the SMITH & WESSON derivative firearm, and, as previously mentioned, retained within the channel 63 by set screw 86 which is threadably engageable with internal threaded portion 65 defined within the channel 63. Set screw 86 enables the user to adjust, through rotation thereof, the level of pressure exerted by plunger detent 82 on frame 52, and, thus, the resistance encountered by linkage housing 62, as may be necessitated due to variances in the dimensions of the frame 52, linkage housing 62 and barrel 56. Furthermore, plunger detent mechanism 80 provides for a self-compensating system, where plunger 82 is free to move further out of, or be forced further into, channel 63 within linkage housing 62, thus also compensating for frame/barrel dimensional differences as noted before.

Referring now to FIGS. 3, 4 and 6, the outer diameter of the barrel 50 from the forward end portion of barrel element 70 to the point of chamber swell may be generally reduced in dimension so as to reduce the angle through which the barrel 56 must traverse in its forward motion to realign with slide 52 during return to battery. Similarly, the opening of slide bushing 26 and insert 74 may be increased appropriately to permit realignment of barrel 56 during such return to battery cycle. One skilled in the art may readily determine the appropriate dimensioning to effect such movement.

Figure 10:
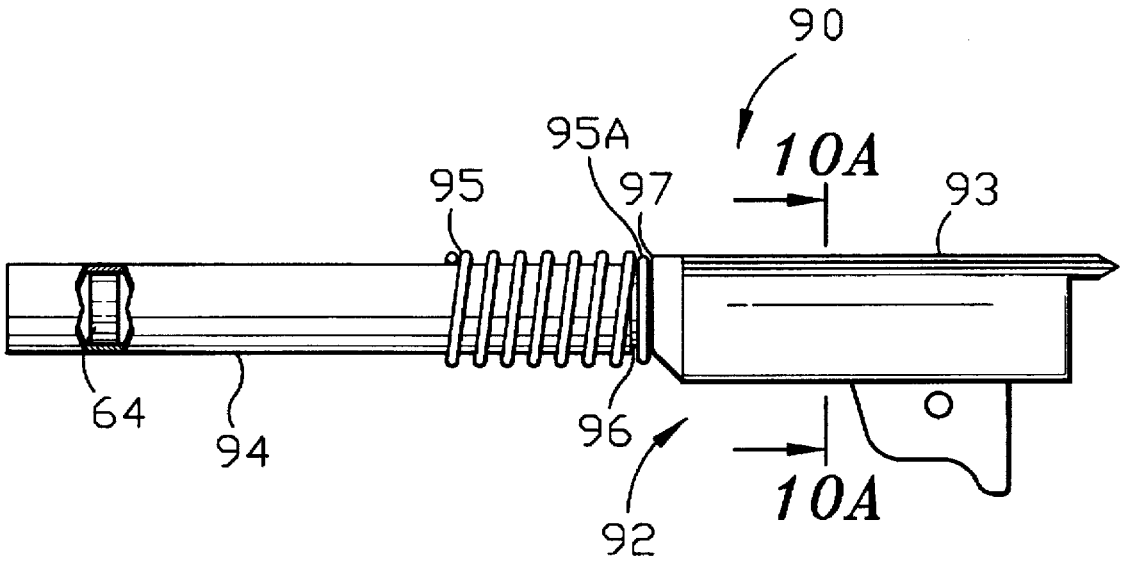
FIG. 10 is an enlarged side elevational view of an alternative embodiment of a modified barrel to be incorporated in the blank firing pistol of FIG. 3.
Figure 10A:
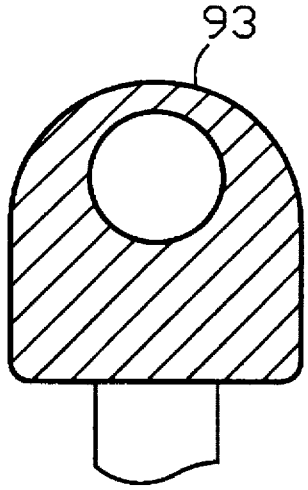

Referring now to FIG. 10, there is illustrated an alternative embodiment of a modified barrel to be incorporated in the blank firing pistol of FIG. 3. Modified barrel 90 includes barrel chamber portion 92 having planar barrel hood area 93 (i.e., the barrel locking ribs have been removed) and barrel element 94 extending from the chamber portion 92. Barrel hood area 93 maintains its arcuate outer surface portion as is with conventional COLT derivative firearms after removal of the locking ribs 30. A helical spring 95 is positioned about barrel element 94. The rearward portion 95*a* of spring 95 is received within a circumferential groove 96 formed in barrel element 94 adjacent chamber portion 92 to fix the rearward portion relative to the barrel element 94. Other methods for securing spring 95 relative to barrel element 94 may be readily determined by one skilled in the art such as adhesives or the like. Helical spring 95 is strategically positioned and dimensioned to impinge upon original slide bushing 26 (FIGS. 3 and 4) or the forward inner surface of the recoiling slide 54 as the slide 54 moves rearwardly in response to firing of the pistol, thereby driving barrel 90 rearwardly and downwardly via the conventional linkage mechanism 24 (FIGS. 1 and 2) to its appropriate position to extract a spent blank cartridge and receive a live cartridge from the magazine. In this respect, spring 95 eliminates the need for rearward bushing 58 of the embodiment of FIG. 6 or bushing insert 74 of the embodiment of FIG. 7.

Spring 95 causes a rearward thrust motion against forward shoulder 97 of chamber 92 during recoiling movement of slide 54 whereby the spring 95 compresses and effects rearward motion of barrel 90 and appropriate rearward tilt via the linkage mechanism 24. The geometries of spring 95 must be such that, in its fully compressed condition, the spring (1) does not interfere with the full rearward travel of the recoiling slide 54; (2) does not in its compressed condition expand in diameter to interfere with the locking recesses 32 (FIG. 1) of the slide 54; and (3) is of sufficient force to effect rearward barrel 90 movement.

Thus, in accordance with the present invention, blank-firing modification of recoil-operated, breech-locked semi-automatic pistols, such as a "BROWNING" or "COLT"/BROWNING derivative firearm, is accomplished by bypassing the mechanical impediment of the breech-locking provision while still effecting rearward barrel tilt for proper positioning of the barrel via barrel bushing 58, bushing insert 74 (FIG. 7) or helical spring 95 (FIG. 10) to expend a cartridge case. The barrel is retained in its rearmost position for the proper duration to permit normal feeding of successive rounds of ammunition into the firing chamber of the barrel 56 by the spring ball detent mechanism 60 (FIG. 8) or plunger detent mechanism (FIG. 9). Thereafter, barrel 56 and slide 54 are returned to battery in a conventional for continued and successive firing of the subsequent blank cartridges.

Referring now to FIGS. 11 and 12 there is illustrated a "GLOCK 17"/SIG-SAUER P226" derivative firearm to be modified in accordance with the principles of the present invention. FIG. 11 is a side elevational view of an unmodified conventional "GLOCK"-type pistol. FIG. 12 is a side elevational view of the barrel unit of the conventional "GLOCK" pistol. Pistol 100 is of conventional type and also incorporates a recoil/breech lock system to operate in a repetitive mode. Pistol 100 includes frame 102, barrel 104 and slide 106 slidably mounted on the frame as is conventional with this pistol design. A breech lock mechanism in the form of a vertical abutment surface 108 of the slide ejection port area 110 engages a vertical abutting surface 112 adjacent barrel chamber 114 to drive barrel 104 rearwardly to its appropriate position during recoil. A recoil spring mechanism (shown schematically as 105) returns barrel 104 to its forward battery position in a similar manner to that of the pistol of FIGS. 1 and 2.

In this design class, no fixed linkage connection exists between the barrel 104 and frame 106, which linkage would limit the upward travel of the barrel 104 within the reciprocating slide 106. However, the upper hood surface 116 of the barrel chamber area 114 maintains a planar contacting surface above the level of the bore and against the underside of reciprocating slide 106 to limit this upward barrel motion within the recoiling slide, thus preventing the barrel 104 from rising upward or forward out of its rearmost frame contact during the case ejection and cartridge-feeding position. In this sense, barrel 104 may be said to "free-float" between frame 102 and slide 106, while its limit of upward and forward movement is contained and determined by the geometries of the component elements of barrel hood 116 and slide underside.

Figure 13:
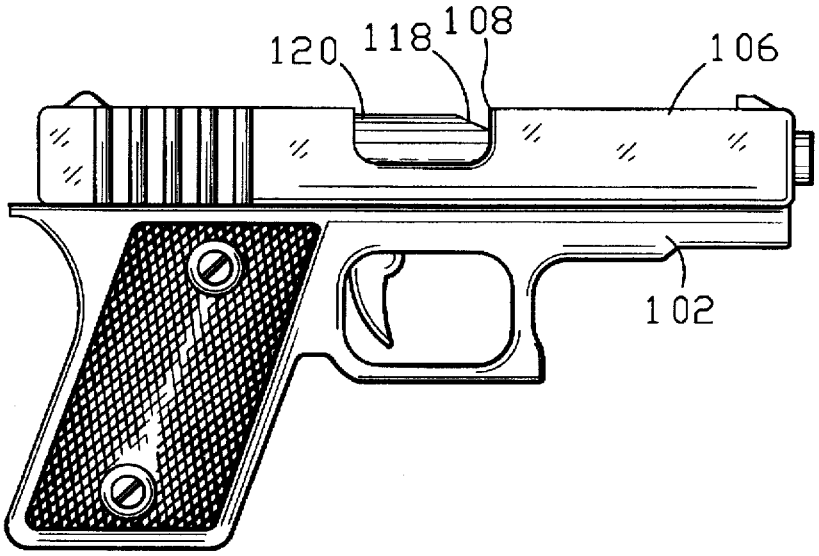
FIG. 13 is a side elevational view of the Glock/Sig-Sauer Type derivative pistol of FIG. 11 modified to fire blank ammunition in accordance with the principles of the present invention.
Figure 14:
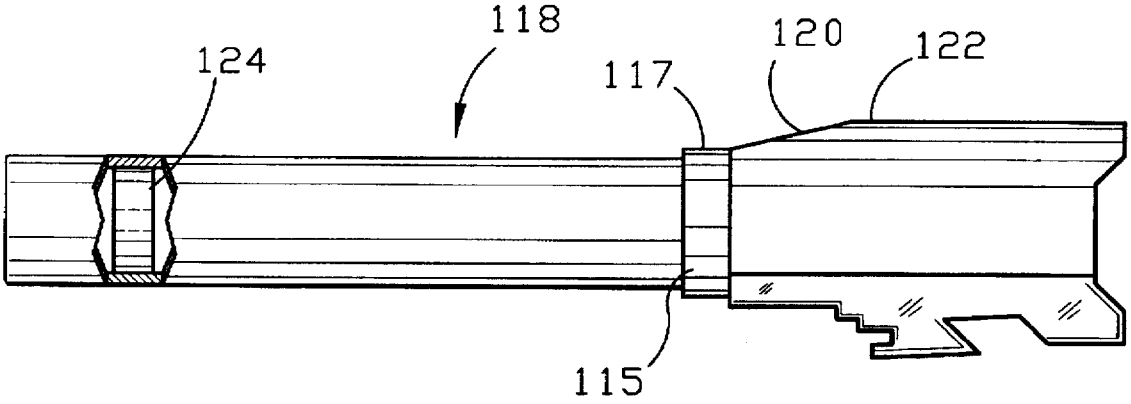
FIG. 14 is an enlarged side elevational view of the modified barrel of the pistol of FIG. 13 modified in accordance with the principles of the present invention.

Referring now to FIGS. 13 and 14 the novel modified blank firing pistol of the "GLOCK 17"/"SIG-SAUER P226" derivative class, depicted in FIGS. 11 and 12, as modified in accordance with the principles of the present invention is illustrated. FIG. 13 is a side elevational view of the modified pistol. FIG. 14 is a side elevational view of the modified barrel 118 incorporated in the pistol of FIG. 13. As shown, the breech locking mechanism which was created between vertical abutment surface 108 and vertical abutting surface 112 has been modified to create a modified blowback system. This alteration is accomplished by modifying the abutting surface 120 of the barrel hood area 122 such that a rearwardly inclined plane of between 10 and 13 degrees relative to the longitudinal axis defined by the bore of the barrel is created as shown. The remaining portion of the barrel hood surface 122 remains unaltered. A restrictor plug 124 is secured within the forward end portion of barrel 118 and functions in a similar manner to the restrictor plug 64 of the embodiment of FIGS. 3 and 4, i.e., to increase the back pressure of propellant gases to facilitate firing of blank ammunition.

The modification to the barrel hood area thus created diminishes the effect of initial barrel/slide locking by allowing a measured or predetermined distance of free-travel of slide 106 to the rear under recoil, thus creating a delay between the slide's rearward movement and its contact with the altered barrel hood incline 120 of the barrel. Consequently, this delay, in concert with the critical angle of the barrel hood incline 120, permits slide 106 to achieve sufficient unimpeded rearward velocity and acquired momentum during the initial stages of the recoil, so that the slide 106 impinges upon the barrel incline 120, driving the barrel 118 rearwardly into cartridge ejection and feeding position, and, simultaneously retaining the barrel hood surface 122 from upward and forward motion limitation within the slide, thus having fixed the rearward orientation of the barrel 118 upon the frame 102 for the purpose of case ejection and subsequent cartridge feeding as the slide reaches and begins its return from full-recoil position. Furthermore, the nature of the critical barrel incline 120 angle permits adequate time for the slide to impart this rearward thrust to the barrel 118 from its forward, in-battery position, without effecting the interference or barrel/slide locking phenomenon normally associated with barrel/slide contact in breech-locked firearm mechanisms.

Modified barrel 118 is retained in the rearward feeding position in order to receive blank ammunition being fed from the magazine in a conventional manner. In particular since the rear end portion of the barrel hood surface 122 is unaltered, contact between the underside of the recoiling slide 106 and the upper barrel positioning flat has been retained. Therefore, the barrel 118 will remain in its rearward feeding position and will accomplish chambering of subsequent blank ammunition, after which the barrel 118 will be driven forward into battery by the normal forward thrust and momentum imparted by the forward motion of slide 106. It is to be appreciated that the outer diameter of barrel 118 may be reduced, by, for example, 0.015 inches to facilitate proper return of barrel 104 to battery as described in connection with the embodiment of FIGS. 3 and 4.

Figure 15:
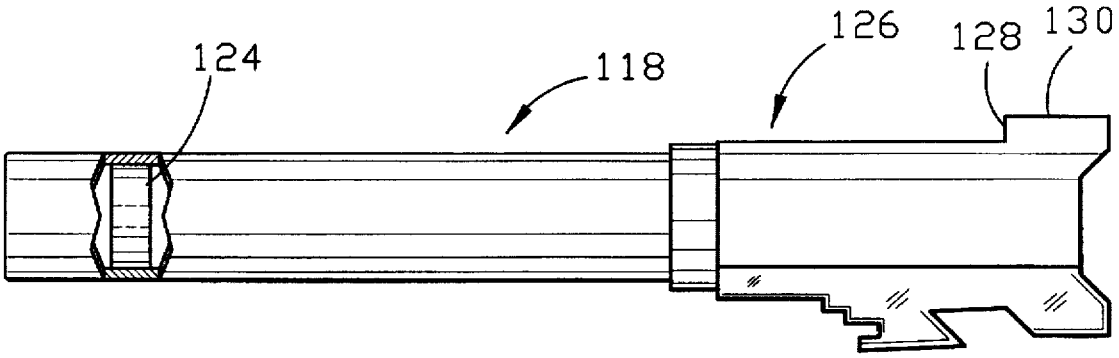
FIG. 15 is a side elevational view of an alternative embodiment of the modified barrel of the present invention to be incorporated in the pistol of FIG. 13.

In an alternative embodiment shown in FIG. 15, the barrel hood area 126 may be modified by a grinding operation or the like to define an abutting surface 128 at a position rearward of the vertical abutting surface 112 of the conventional pistol 100 depicted in FIGS. 11 and 12. By displacing the abutting surface 128 a predetermined distance from the forward end portion of barrel hood area 126, slide 106 is permitted to move rearwardly a substantial distance before contacting abutting surface 128, thereby enabling the slide to achieve an increased rearward velocity and momentum to drive the barrel rearwardly into appropriate cartridge ejection and feeding position. Abutting surface 128 may be a vertical surface, i.e., at an angle of 90 degrees relative to the longitudinal axis of the barrel bore as shown in FIG. 15. It is also to be appreciated that abutting surface 128 may assume other angular orientations to achieve the intended purpose of being engaging by slide 106 so as to drive the barrel to the cartridge feeding and ejecting position. One skilled in the art may readily determine the appropriate positioning and orientation of abutting surface 128 to achieve this objective. The barrel will remain in its rearward position to accomplish chambering of a subsequent blank cartridge by the contact between the unaltered rear end portion of the barrel hood surface 130 and the underside of recoiling slide 106.

Figure 16:
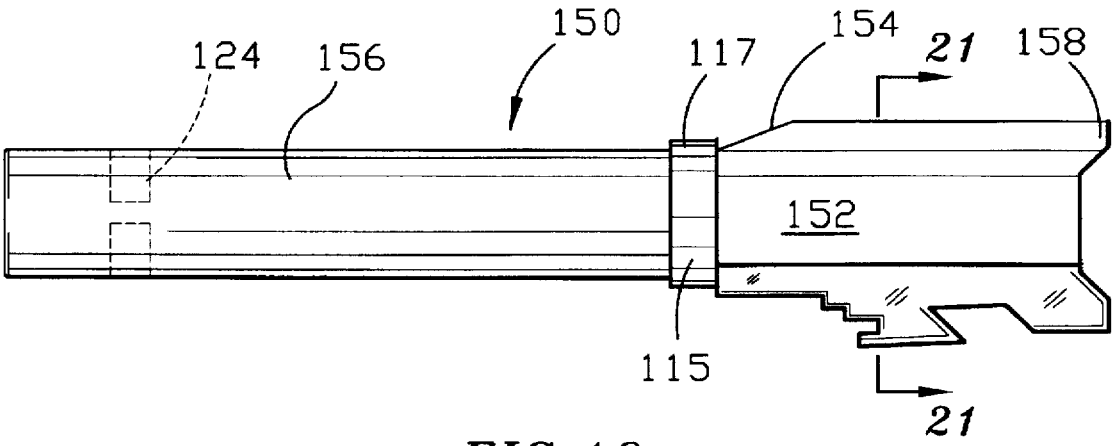
FIG. 16 is a side elevational view of another alternative embodiment of the modified barrel of the present invention to be incorporated in the pistol of FIG. 13.

Referring now to FIG. 16, there is illustrated an alternative modified barrel 150 to be incorporated in the blank firing pistol of FIGS. 13 and 14. Modified barrel 150 includes barrel hood chamber area 152 having inclined abutting surface 154 which is similar in some respects to the abutting surface 120 described in connection with barrel of FIG. 14. However, in accordance with this embodiment of modified barrel 150, the forward portion of abutting surface 154 commences at a position lower than that of the modified barrel of FIG. 14. In particular, in the modified barrel of FIG. 14, the inclined abutting surface 120 begins substantially even with the upper surface 117 of barrel spacer ring 115 and extends rearwardly at the appropriate angle. In accordance with the embodiment of FIG. 15, abutting surface 154 commences at a point below the upper surface 117 of spacer ring 115 and below the lowest point of the vertical locking shelf 112 of the conventional unmodified barrel 104 of FIG. 12. The significance of such configuration is at least threefold: 1) this geometry has the effect of moving the contact point of the recoiling slide 106 and the angled abutment 154 rearward and higher up on the abutment incline plane, thus permitting an increase in the velocity and rearward momentum of the slide 106, while producing diminished contact time between the slide and barrel 150 between these two elements before the barrel 150 drops to its unlocked position; 2) by alteration of this contact point, the slide 106 has been provided with a greater window of time in which to strike the barrel 150 upon the incline 154, thus increasing the momentum and force of contact; and 3) since the point of contact upon the incline 154 is higher up on its plane, the underside edge of the slide vertical locking surface 108 (FIG. 13) traverses a shorter distance upon that incline, creating a diminished frictional effect upon the barrel 150.

The beginning of inclined abutting surface 154 is preferably from 0.008" to 0.020' (depending on the GLOCK model type) below the lowest point 113 of the vertical abutting surface 112 of the unmodified barrel 104 of FIG. 12. Furthermore, the plane defined by abutting surface 154 of modified barrel 150 is optimized at 13° relative to the longitudinal axis of barrel element 156.

Figure 17:
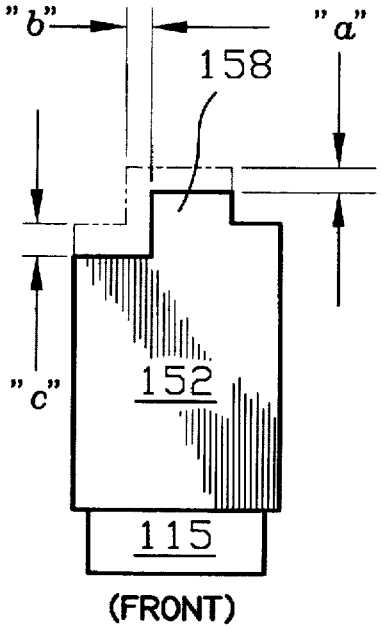
FIG. 17 is a top plan view of the barrel chamber area of the modified barrel of FIG. 16 illustrating the modified barrel hood surface and rear barrel hood extension.
Figure 18:
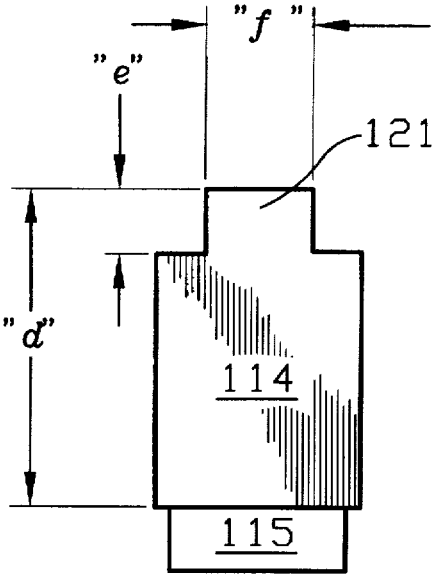
FIG. 18 PRIOR ART
FIG. 18 is a top plan view of the barrel chamber area of the unmodified conventional barrel of FIG. 12 prior to modifying same illustrating the barrel hood surface and rear barrel hood extension.

Referring now to FIGS. 17 and 18, further features of barrel chamber area 152 are illustrated in detail. FIG. 17 illustrates a top plan view of barrel chamber area 152 of modified barrel 150 of FIG. 16 and FIG. 18 illustrates a similar view of the unmodified barrel of FIG. 12 for comparison purposes. The original dimensions of the unmodified barrel of FIG. 12 are also shown in phantom in FIG. 17. As shown in FIG. 17, barrel chamber area 152 is configured in a manner which facilitates blank case ejection and loading during recoil. During the firing of blank ammunition, the blank cartridge typically undergoes a distortion of its geometrical characteristics, e.g., the overall length of the cartridge may increase due to the distortion of the oblique front portion of the blank case which becomes substantially cylindrical during firing, or, the cartridge may decrease or expand due to back pressure during firing. Accordingly, to accommodate the variations in these fired blank cartridges, rear barrel hood extension 158 is modified by reducing its length a predetermined distance "a". Such reduction reduces the possible area of contact with the spent cartridge case upon ejection, thus preventing case jamming, while still preserving the barrel hood extension's function of maintaining an upward stop that prevents the cartridge being fed into chamber 152 from leaping upward causing a "stovepipe" jam. Further, the width of barrel hood extension 158 is reduced on one side, i.e., the side where the fired cartridge is ejected, a predetermined distance "b" to further prevent case jamming during the ejection cycle. In a similar manner, the right rear side of the chamber mouth is moved forward a distance "c", thus, in effect shortening it. This further prevents case jamming during the ejection cycle, as the case is pivoted outwardly to the right by the frame-mounted ejector component (not shown).

In the "GLOCK" models 17, 19 and 23, the distances "a", "b", and "c" are 0.060, 0.080 and 0.030" respectively. One skilled in the art may readily determine the appropriate distances for other "GLOCK" models as well as other firearms including the "SIG-SAUER", "RUGER", "HECKLER & KOCH" and derivatives thereof.

Referring to FIG. 18, the dimensions of the unmodified barrel chamber area 114 of conventional "GLOCK" models 17, 19 and 23 are as follows:

| Dimension | Inches |
|---|---|
| "d" | 1.218 to 1.220 |
| "e" | 0.146 to 0.156 |
| "f" | 0.393 to 0.400 |
| | 0.429 (M23) |

Figure 19:
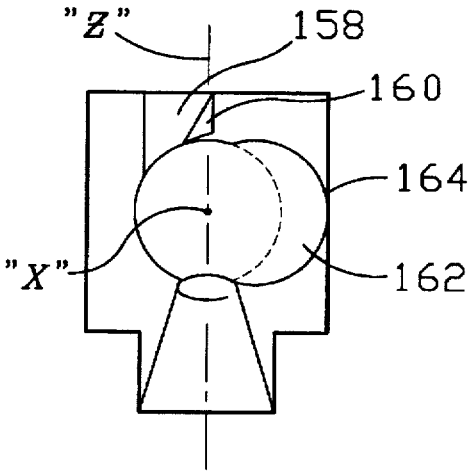
FIG. 19 is an axial view of the modified barrel of FIG. 16 illustrating entry into the barrel chamber area and the barrel hood area.
Figure 20:
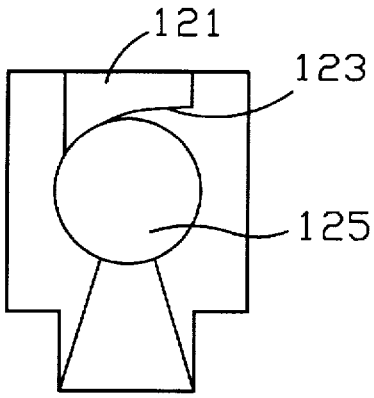
FIG. 20 PRIOR ART
FIG. 20 is an axial view of the unmodified conventional barrel of FIG. 12 illustrating entry into the barrel chamber area and the barrel hood extension.

Referring now to FIGS. 19 and 20 further modifications to the original barrel to facilitate case ejection and loading into chamber 152 are depicted. FIG. 19 illustrates an axial view into barrel chamber 152 of modified barrel 150. FIG. 20 shows a similar view of the conventional barrel 104 of FIG. 12 prior to the additional modifications. As shown in FIG. 20, the original barrel hood extension 121 of the unmodified barrel defines a circumferential are 123 adjacent the chamber mouth 125, which guides the live cartridge into the chamber 114. However, due to the aforementioned geometries and distortions of the blank cartridge, it has been found that by eliminating a portion of the arc, the blank cartridge can more easily be ejected by the ejection unit. Referring to FIG. 19, the fight underside (relative to the drawings) of the barrel hood extension 158 which has been lessened in width has approximately a 45° angled and tapered (or bevelled) relief cut 160 formed by milling or grinding or the like on the right rear underside. This cut is preferably oriented approximately at 45° from the axis "x" of chamber, at approximately the 1 o'clock position as viewed from the rear and approximately 45° angle upward from the bore axis. One skilled in the art can determine other appropriate angular orientations for relief cut 160 and chamfered are 162. Further, adjacent the rear right side of the chamber mouth 160 a 45° chamfered are 162 relative to radius cross-section plane "z" of chamber 152 is formed. The arc 162 extends from the right rear side 164 of barrel chamber 152 towards the front of the chamber and inwardly towards the axis "x" of the chamber to define a chamfer/beveled surface. Such surface also facilitates case ejection.

Figure 21:
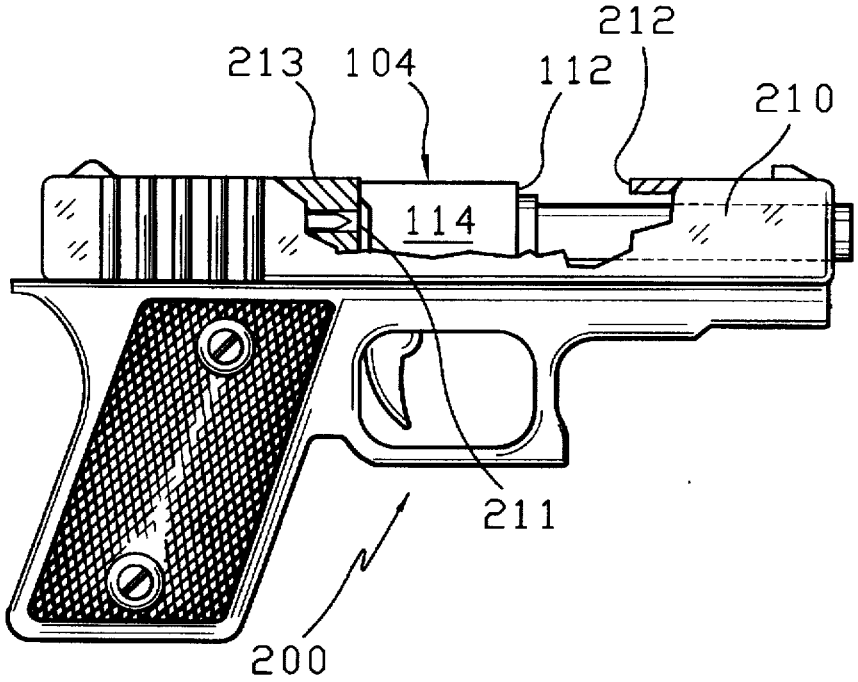
FIG. 21 is a side elevational view in partial cross-section of another alternative embodiment of the present invention illustrating the vertical abutment surface of the slide displaced to a forward position to permit rearward movement of the slide prior to engagement with the barrel unit.

Referring now to FIG. 21, in conjunction with FIG. 12, there is illustrated an alternative embodiment of the blank firing pistol modified in accordance with the principles of the present invention. Pistol 200 is a "GLOCK"/SIG-SAUER type derivative pistol such as the pistol depicted in FIGS. 11–12 and incorporates a conventional barrel unit 104 having barrel chamber portion 114 and a barrel dement extending from the barrel chamber portion 114 as best shown in FIG. 12. A vertical abutting surface 112 as defined at the juncture of the barrel chamber portion 114 and the barrel element is provided as is conventional with pistols of this type. Slide 210 possesses a vertical abutment surface 212 which has been displaced from its original position adjacent the slide ejection port area 214 (see FIG. 11) towards the forward end of the slide 210. By displacing the vertical abutment surface 212 a predetermined distance towards the forward end portion of slide 210, the slide is permitted to move rearwardly a substantial distance before contacting abutting surface 112 of conventional barrel unit 104, thereby enabling the slide 210 to achieve the desired increased rearward velocity and momentum to drive the barrel unit 104 rearwardly and downwardly into appropriate cartridge ejection and feeding position in a manner similar to that described in connection with the embodiment of FIGS. 13 and 14. In the preferred embodiment, vertical abutment surface 212 is displaced forward from its original position by between about 0.050 inches and 0.150 inches. Barrel unit 104 remains in its rearward position to accomplish chambering of a subsequent blank cartridge by the contact between the unaltered rear surface portion of barrel chamber portion 114 and the underside of recoiling slide 210. Barrel unit 104 is returned to the forward battery position by the normal forward thrust and momentum imparted by the forward motion of slide 106, i.e., forward movement of slide 210 as effectuated by the recoil spring mechanism (not shown) causes corresponding forward movement of barrel unit 104 through the contact between the rear end portion of barrel chamber portion 114 and the breech face 211 of barrel block 213 of slide 210.

Figure 22:
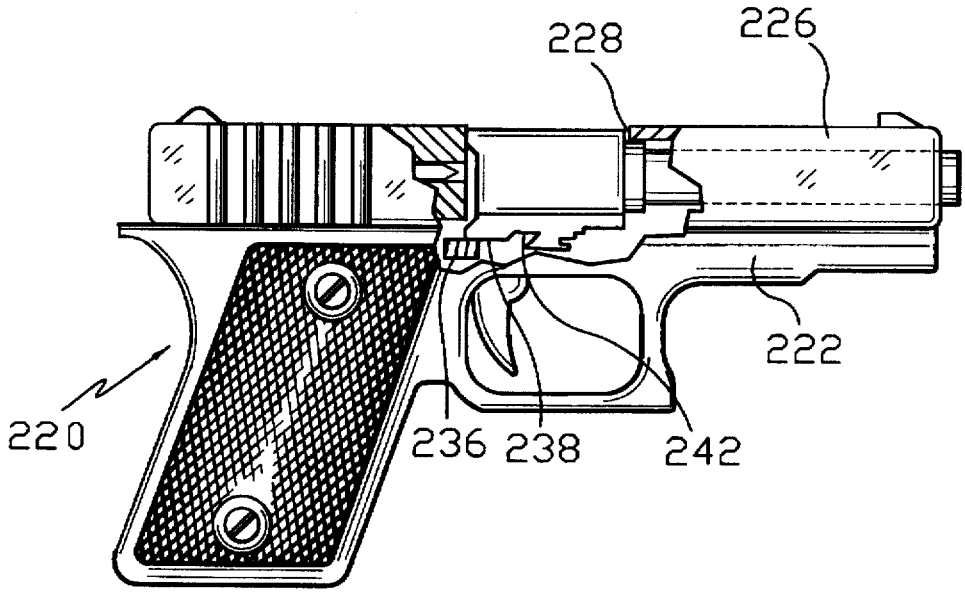
FIG. 22 is a side elevational view in partial cross-section of a conventional "GLOCK"/"SIG-SAUER"/"HECKLER & KOCK(HK) type derivative pistol which is to modified in accordance with the principals of the present invention.
Figure 23:
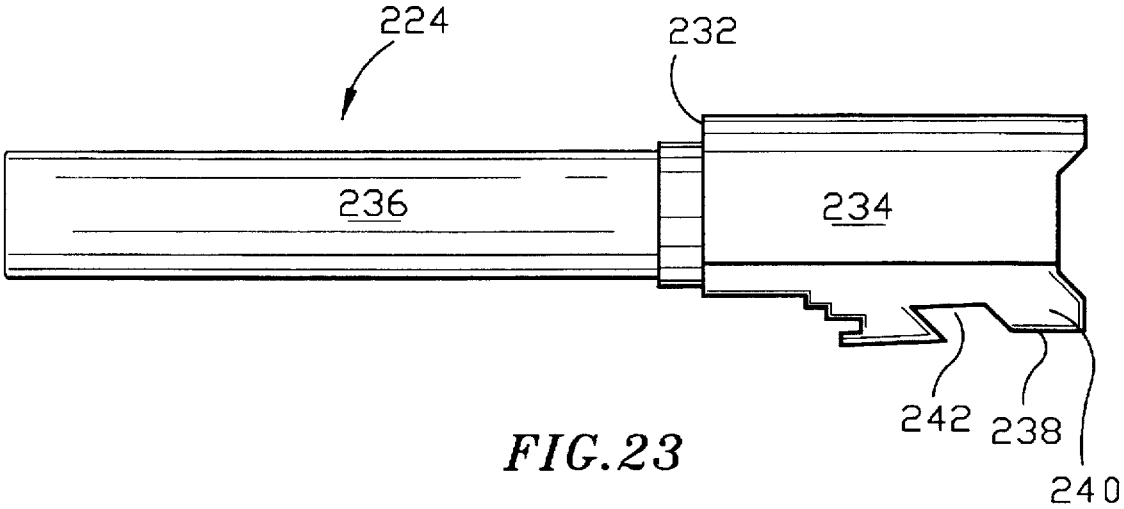
FIG. 23 is an enlarged side elevational view of the barrel unit of the pistol of FIG. 22 prior to modification of same.
Figure 24:
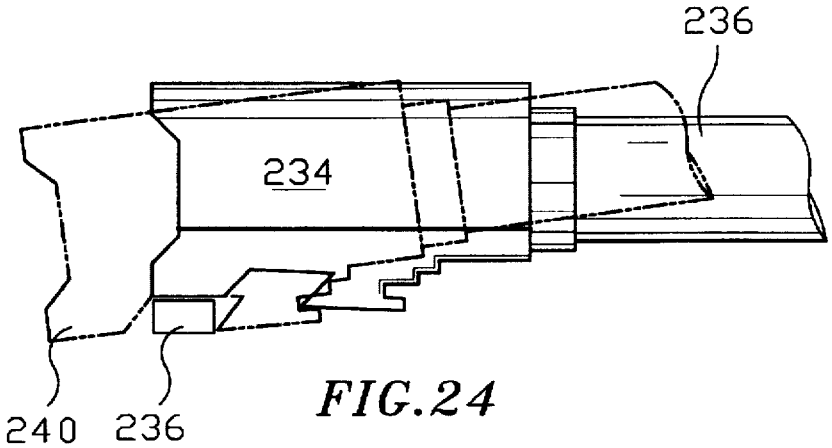
FIG. 24 is an enlarged side elevational view of a portion of the barrel unit of FIG. 23 illustrating the relationship of the barrel unit and the frame support surface of the slide.

Referring now to FIGS. 22–24, there is illustrated a conventional "GLOCK"/"SIG-SAUER"/"HECKLER & KOCK (H.K.)" derivative pistol to be modified in accordance with the principles of the present invention. Pistol 220 incorporates a recoil/breech lock system to operate in a repetitive mode and includes a frame 222, barrel unit 224 and slide 226 slidably mounted on a frame 222 as is conventional with pistols of this type. The barrel lock mechanism is in the form of a vertical abutment surface 228 defined at the slide ejection port area 230 which engages a vertical abutting surface 232 defined at the juncture of barrel chamber 234 and barrel element 236 to drive the barrel 224 rearwardly during recoil for cartridge ejection and feeding.

Pistol 220 also incorporates a recoil spring mechanism (not shown) to return slide 226 and, consequently, barrel unit 224 to the forward battery position.

Barrel unit 224 is supported by frame 222 via frame support camming surface 236 which extends inwardly across from the frame and abuts the underside 238 of barrel feed ramp 240 of the barrel unit. Barrel feed ramp underside 238 in combination with frame support surface 236 governs the rate of barrel drop into recoil/cartridge feed position. In particular, as slide 226 and barrel unit 224 move rearwardly, feed ramp underside 238 traverses frame support surface 236 whereupon clearing the support surface 236, the barrel unit 224 drops downwardly to its appropriate cartridge feeding position (i.e., recess 242 in the underside of barrel unit 224 accommodates frame support surface 236) as shown in phantom in FIG. 24. FIG. 24 illustrates the positioning of barrel unit 224 in its forward battery position and also shows by phantom lines the positioning of barrel unit 224 in its cartridge feeding position subsequent to recoil. Barrel feed ramp 240 facilitates feeding of a cartridge into barrel chamber portion 234.

Figure 25:
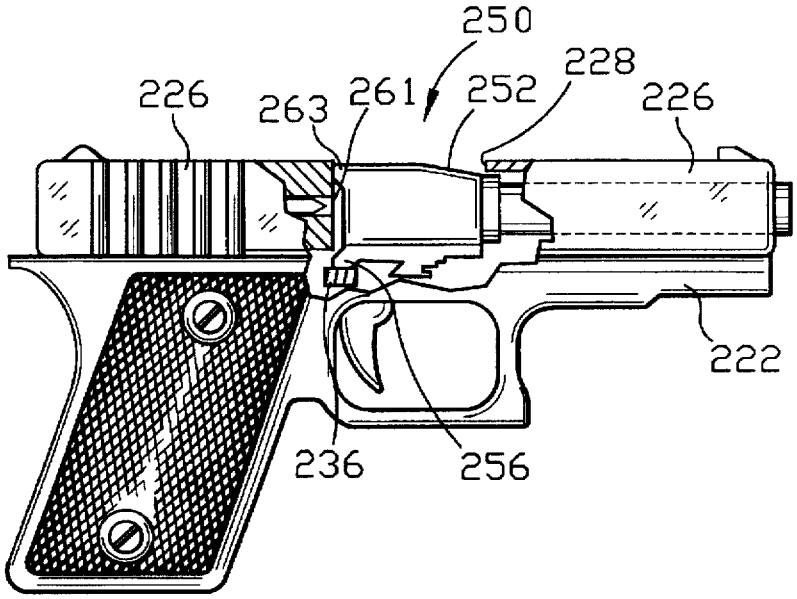
FIG. 25 is a side elevational view in partial cross-section of the pistol of FIG. 22 modified in accordance with the principles of the present invention to fire blank ammunition.
Figure 26:
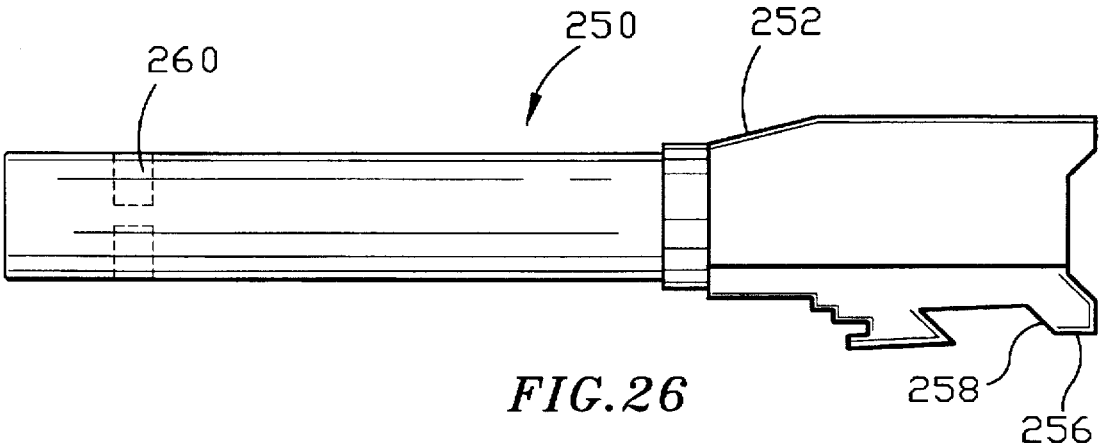
FIG. 26 is an enlarged side elevational view of the modified barrel of the pistol of FIG. 26.
Figure 27:
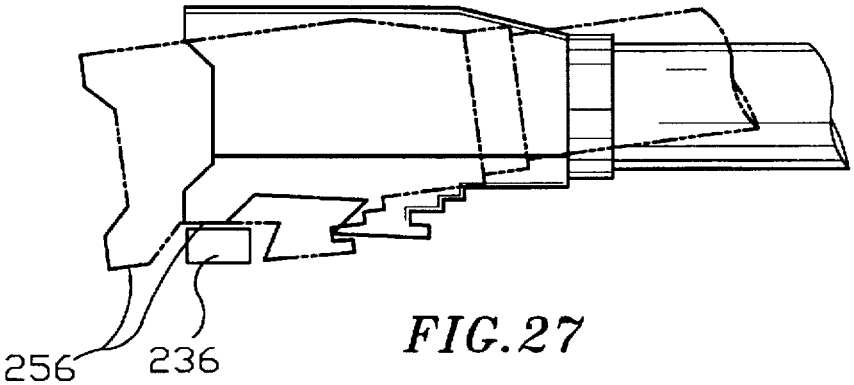
FIG. 27 is a view similar to the view of FIG. 24 illustrating the relationship of the modified barrel unit and the frame support surface of the slide.

Referring now to FIGS. 25–27, there is illustrated the pistol of FIGS. 22–24 modified to fire blank ammunition. Slide 226 and frame 222 remain unaltered in this embodiment. However, barrel unit 250 has been modified to define an abutting surface 252 ranging between about 8° and about 15° relative to the longitudinal axis of barrel element 254 in a manner similar to that described in connection with the embodiment of FIGS. 13–14, to provide initial unimpeded rearward movement of slide 222 prior to engagement of abutment surface 228 of slide 226 with the abutting surface 252. In addition, barrel feed ramp underside 256 has been shortened by moving the forwardmost upwardly-angled surface 258 of the ramp underside 256 to the rear at an oblique angle which approximates the original angle configuration. This shortens the feed ramp underside 256 contact with frame camming surface 236, thereby effectually reducing the time and distance necessary for the barrel unit 250 to drop downwardly into its rearward recoil/cartridge feeding position (as shown in phantom in FIG. 27) and, consequently, reducing the amount of recoil force required to drive the slide and barrel rearwardly. Preferably, barrel feed ramp underside 256 is shortened by about 25% to about 75% of its original length. Thus, the combination of the angled abutting surface 252 with the shortened feed ramp underside 256 enables the blank firing pistol to operate in a repetitive automatic manner with the barrel unit dropping to cartridge feeding position at the appropriate time sequence. Barrel 250 also includes a restrictor element 260 to generate sufficient back pressure upon firing of a blank cartridge to drive the slide rearwardly and a recoil spring mechanism (see FIGS. 1–2) to return the slide and barrel (via impingement of breach face 261 on rear barrel hood extension 263) to battery.

It is to be noted that while two representatives classes of recoil-operated, breech locked firearms are used for examples, the embodiments put forth apply equally to firearms possessing similar design elements, and include, though are not necessarily limited to the "RUGER" P85/P89/P90, the "SMITH & WESSON" 39/59/5900/6900—Series, "BROWNING" and "COLT"/"BROWNING" derivative firearms, as well as other recoil-operated, breech-locked pistols possessing a barrel/slide-mated locking surface provision, and chambered in, but not limited to, calibers 9mm "PARABELLUM, ".45 ACP", ".40 S+w", 10mm, 9mm "WINCHESTER MAGNUM", ".45 WINCHESTER MAGNUM", ".30m CARBINE", or other calibers utilized in recoil-operated, breech-locked firing mechanisms.

It will be understood that various modifications can be made to the embodiments of the present invention herein disclosed without departing from the spirit thereof. The above description should not be construed as limiting the invention but merely as exemplifications of preferred embodiments thereof. Those skilled in the art will envision other modifications within the scope and spirit of the present invention as defined by the claims appended hereto.

What is claimed is:

1. An automatic pistol for firing blank ammunition, which comprises:

a frame;

a barrel unit including a barrel chamber portion and a generally cylindrically shaped barrel element extending from said barrel chamber portion;

a slide mounted on said frame and adapted for reciprocal longitudinal movement relative thereto between a forward battery position and a rearward position;

means for constricting the diameter of the bore of said barrel element, said constricting means dimensioned and configured to generate sufficient back pressure in said barrel unit upon firing of a blank cartridge to move said slide to said rearward position;

a slide bushing member mounted to a forward end portion of said slide for reception of a forward end portion of said barrel element; and an engaging member positioned about said barrel element for driving said barrel unit rearwardly during rearward movement of said slide to a loading position wherein a blank cartridge is loaded within said barrel chamber portion of said barrel unit.

2. The automatic pistol of claim 1 wherein said engaging member is positioned and dimensioned to permit rearward movement of said slide for a predetermined distance prior to operative engagement of said slide with said barrel unit.

3. The automatic pistol of claim 2 wherein said barrel unit includes a barrel linkage housing extending downwardly from said barrel chamber portion.

4. The automatic pistol of claim 3 wherein said barrel unit is connected to said frame by a pivotal connecting link connected to said barrel linkage housing.

5. The automatic pistol of claim 4 wherein said barrel chamber portion defines a generally planar upper surface.

6. The automatic pistol of claim 1 wherein said engaging member comprises a second bushing member positioned about said barrel element and secured to said barrel element at a position adjacent said barrel chamber portion, said second bushing member dimensioned and configured to be engaged by said slide bushing member upon movement of said slide to said rearward position thereof to drive said barrel unit rearwardly to receive a blank cartridge.

7. The automatic pistol of claim 1 wherein said engaging member is associated with said slide bushing member and at least extends rearwardly from said slide bushing member.

8. The automatic pistol of claim 7 wherein said engaging member comprises an insert member inserted within said slide bushing member, said insert member defining a bore for reception of a forward end portion of said barrel element, said insert member extending rearwardly beyond said slide bushing member and being dimensioned to operatively engage said barrel unit upon movement of said slide to said rearward position to drive said barrel unit rearwardly to a position to receive a blank cartridge.

9. The automatic pistol of claim 8 wherein the juncture of said barrel chamber portion and said barrel element of said barrel unit defines a generally vertical abutment surface, said vertical surface being engaged by said insert member upon movement of said slide to said rearward position thereby driving said barrel unit rearwardly to a position to receive a blank cartridge.

10. The automatic pistol of claim 5 wherein means is provided to retain said barrel unit for a predetermined period of time in the position wherein said barrel chamber portion receives a blank cartridge.

11. The automatic pistol of claim 10 wherein said means to retain said barrel unit comprises spring means disposed between said barrel linkage housing and said frame, said spring means operatively connected to said barrel linkage housing and configured and dimensioned to frictionally engage said frame so as to retain said barrel unit for said predetermined period of time in the rearward position of said barrel unit.

12. The automatic pistol of claim 6 wherein said second bushing member is positioned and dimensioned to permit rearward movement of said slide for a predetermined distance prior to engagement of said slide bushing member with said second bushing member.

13. The automatic pistol of claim 8 wherein said insert member is positioned and dimensioned to permit rearward movement of said slide for a predetermined distance prior to operative engagement of said insert member with said barrel unit.

14. The automatic pistol of claim 7 wherein said engaging member is positioned and dimensioned to permit rearward movement of said slide for a predetermined distance prior to operative engagement of said engaging member with said barrel unit.

15. The automatic pistol of claim 1 including a detent mechanism associated with said barrel unit and operatively engagable with said frame, said detent mechanism dimensioned and configured to retain said barrel unit in said loading position during loading of a blank cartridge in said barrel chamber portion.

16. The automatic pistol of claim 15 wherein said detent mechanism includes a contacting member mounted with respect to said barrel linkage housing and engagable with one of said frame and said barrel linkage housing, said contacting member dimensioned and configured to resist movement of said barrel unit from said loading position during loading of a live blank cartridge through frictional contact of said contacting member with said one of said frame and said barrel linkage housing.

17. The automatic pistol of claim 16 wherein said detent mechanism includes a spring member operatively connected to said contacting member for biasing said contacting member into engagement with said one of said frame and said barrel linkage housing.

18. The automatic pistol of claim 17 wherein said contacting member is one of a plunger detent and a bail detent.

19. The automatic pistol of claim 18 wherein said detent mechanism is at least partially housed in a channel formed in said barrel linkage housing and wherein said contacting member is positioned to engage said frame.

20. The automatic pistol of claim 19 including adjusting means for adjusting the level of force applied by said contacting member against said frame.

21. The automatic pistol of claim 20 wherein said adjusting means includes a set screw, said set screw operatively connected to said spring, wherein rotation of said set screw displaces said spring to adjust the level of force applied by said contacting member.

22. The automatic pistol of claim 16 wherein said engaging member is positioned and dimensioned to permit rearward movement of said slide for a predetermined distance prior to operative engagement with said barrel unit.

23. A firearm for firing blank ammunition, which comprises:

a frame;

a barrel unit including a barrel chamber portion, a barrel element extending from said barrel chamber portion and a barrel linkage housing extending downwardly from said barrel chamber portion;

a slide mounted on said frame and adapted for reciprocal longitudinal movement relative thereto between a forward battery position and a rearward position;

a slide bushing member mounted to a forward end potion of said slide for reception of a forward end portion of said barrel element;

a second bushing member positioned about said barrel element and secured to said barrel element at a position adjacent said barrel chamber portion, said second bushing member dimensioned and configured to be engaged by said slide bushing member upon movement of said slide to said rearward position thereof to drive said barrel unit rearwardly to receive a blank cartridge, said second bushing member dimensioned and positioned to permit rearward movement of said slide a predetermined distance prior to engagement of said second bushing member with said slide bushing member; and a detent mechanism associated with said barrel unit and operatively engagable with said frame, said detent mechanism including a contacting member mounted with respect to said barrel linkage housing and engagable with one of said frame and said barrel linkage housing, said contacting member dimensioned and configured to resist movement of said barrel unit from said loading position during loading of a live blank cartridge through frictional contact of said contacting member with said one of said frame and said barrel linkage housing.

24. An automatic pistol for firing blank ammunition, which comprises:

a frame;

a barrel unit including a barrel chamber portion, a barrel element extending from said barrel chamber portion and a barrel linkage housing extending downwardly from said barrel chamber portion, said modified barrel connected to said frame by a pivotal connecting link connected to said barrel linkage housing;

a slide mounted on said frame and adapted for reciprocal longitudinal movement relative thereto between a forward battery position and a rearward position;

a slide bushing member mounted to a forward end portion of said slide for reception of a forward end of said barrel element;

a second bushing member associated with said slide bushing member and extending rearwardly from said slide bushing member, said second bushing member dimensioned to engage an abutment surface of said barrel unit during movement of said slide to said rearward position to drive said barrel unit rearwardly to a position to receive a blank cartridge, said second bushing member dimensioned and positioned to permit rearward movement of said slide a predetermined distance prior to engagement of said second bushing member with said abutment surface of said barrel unit; and a detent mechanism associated with said barrel unit and operatively engagable with said frame, said detent mechanism including a contacting member mounted with respect to said barrel linkage housing and engagable with one of said frame and said barrel linkage housing, said contacting member dimensioned and configured to resist movement of said barrel unit from said loading position during loading of a live blank cartridge through frictional contact of said contacting member with said one of said frame and said barrel linkage housing.

25. The automatic pistol of claim 24 wherein said second bushing member comprises an insert member inserted within said slide bushing member and positioned about said forward end portion of said barrel elements, said insert member defining a bore for reception of a forward end portion of said barrel element, said insert member extending rearwardly beyond said slide bushing member and being dimensioned to operatively engage said barrel unit upon movement of said slide to said rearward position to drive said barrel unit rearwardly to a position to receive a blank cartridge.

* * * * *